US008565657B2

(12) United States Patent
Barton et al.

(10) Patent No.: US 8,565,657 B2
(45) Date of Patent: Oct. 22, 2013

(54) REDISTRIBUTING RELEASE AGENT USING A FLEXIBLE BLADE IN AN IMAGE FORMING SYSTEM

(75) Inventors: Augusto E. Barton, Webster, NY (US); James Padula, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/914,365

(22) Filed: Oct. 28, 2010

(65) Prior Publication Data

US 2012/0107027 A1 May 3, 2012

(51) Int. Cl.
*G03G 15/20* (2006.01)

(52) U.S. Cl.
USPC ..... 399/325; 399/326

(58) Field of Classification Search
USPC ..... 399/324, 326, 325, 327, 329
See application file for complete search history.

(56) References Cited

U.S. PATENT DOCUMENTS 5,625,859 A * 4/1997 Moser ..... 399/325
5,920,947 A 7/1999 Varner
5,987,293 A * 11/1999 Diels ..... 399/325
6,126,756 A 10/2000 Varner
6,243,911 B1 6/2001 Varner
6,266,509 B1 * 7/2001 Ota et al. ..... 399/325
6,449,456 B1 * 9/2002 Cahill et al. ..... 399/325
6,925,280 B2 * 8/2005 Yamada ..... 399/325
7,708,377 B2 * 5/2010 Thayer et al. ..... 399/326 X

* cited by examiner

*Primary Examiner* — Sandra Brase

(74) *Attorney, Agent, or Firm* — Ronald E. Prass, Jr.; Prass LLP

(57) ABSTRACT

According to various illustrative embodiments, an apparatus for redistributing release agent on a fuser surface of an image forming device is provided. The apparatus includes a fuser surface for contacting a sheet of media having an image formed thereon by the image forming device, the fuser surface moving in a traveling direction; and a flexible blade for redistributing the release agent on the fuser surface from a first post-fusing distribution to a second distribution, the flexible blade contacting the release agent on the fuser surface at a contact area and pressing the release agent against the fuser surface to redistribute the release agent from the first post-fusing distribution to the second distribution, wherein the flexible blade is adapted to redistribute the release agent such that the second distribution is more uniform across the fuser surface than the first post-fusing distribution.

21 Claims, 2 Drawing Sheets

REDISTRIBUTING RELEASE AGENT USING A FLEXIBLE BLADE IN AN IMAGE FORMING SYSTEM

BACKGROUND

The present disclosure relates generally to fuser release fluid control in imaging systems. More particularly, the present disclosure describes an apparatus, method, and system useful for reducing oil ghosting in imaging systems.

The fuser release fluid distribution on the surface of a roll or belt in an imaging system can have detrimental effects on image quality if not properly controlled. For example, if release fluid (for example, oil) is not evenly distributed on the portion of a surface (for example, a fuser roll or belt) that comes in contact with the media, oil ghosting can result in the form of a gloss band on the media. Oil ghosting can result from excess oil on, for example, the inter document zone (IDZ) of the fuser surface that exists between sheets of media, or on the outside paper path (OPP) area of the fuser surface when switching to wider media.

SUMMARY

An apparatus for redistributing release agent on a fuser surface of an image forming device is provided. The apparatus has a fuser surface for contacting a sheet of media having an image formed thereon by the image forming device, the fuser surface moving in a traveling direction; and a flexible blade for redistributing the release agent on the fuser surface from a first post-fusing distribution to a second distribution, the flexible blade contacting the release agent on the fuser surface at a contact area and pressing the release agent against the fuser surface to redistribute the release agent from the first post-fusing distribution to the second distribution, wherein the flexible blade is adapted to redistribute the release agent such that the second distribution is more uniform across the fuser surface than the first post-fusing distribution.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the present embodiments and further features and advantages thereof may be acquired by referring to the following description taken in conjunction with the accompanying drawings, wherein.

Figure 1:
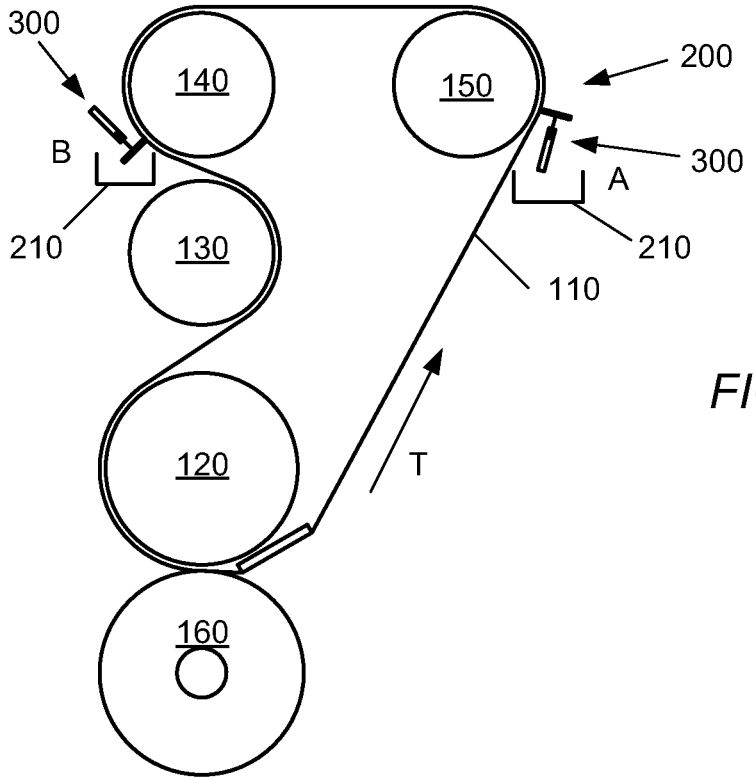
FIG. 1 schematically illustrates a particular example of various illustrative embodiments of an apparatus in accordance with the present disclosure.

It is to be noted, however, that the appended drawings illustrate only typical embodiments of the disclosed subject matter and are, therefore, not to be considered limiting of the scope of the disclosed subject matter, as the disclosed subject matter may admit to other equally effective embodiments.

DETAILED DESCRIPTION

Illustrative embodiments are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

The disclosed embodiments may include an apparatus for redistributing release agent on a fuser surface of an image forming device. The apparatus has a fuser surface for contacting a sheet of media having an image formed thereon by the image forming device, the fuser surface moving in a traveling direction; and a flexible blade for redistributing the release agent on the fuser surface from a first post-fusing distribution to a second distribution, the flexible blade contacting the release agent on the fuser surface at a contact area and pressing the release agent against the fuser surface to redistribute the release agent from the first post-fusing distribution to the second distribution. The flexible blade is adapted to redistribute the release agent such that the second distribution is more uniform across the fuser surface than the first post-fusing distribution.

The disclosed embodiments may further include an image forming device. The image forming device has a media transport path for transporting a sheet of media having an image formed thereon; a fuser surface for contacting the sheet of media, the fuser surface moving in a traveling direction; and a flexible blade for redistributing release agent on the fuser surface from a first post-fusing distribution to a second distribution, the flexible blade contacting the release agent on the fuser surface at a contact area and pressing the release agent against the fuser surface to redistribute the release agent from the first post-fusing distribution to the second distribution. The flexible blade is adapted to redistribute the release agent such that the second distribution is more uniform across the fuser surface than the first post-fusing distribution.

The disclosed embodiments may further include a method of redistributing release agent on a fuser surface of an image forming device. The method includes providing a fuser surface for contacting a sheet of media having an image formed thereon by the image forming device; moving the fuser surface in a traveling direction; contacting a release agent present on the fuser surface with a flexible blade such that the flexible blade redistributes the release agent on the fuser surface from a first post-fusing distribution to a second distribution, the flexible blade contacting the release agent on the fuser surface at a contact area and pressing the release agent against the fuser surface to redistribute the release agent from the first post-fusing distribution to the second distribution, wherein the flexible blade redistributes the release agent such that the second distribution is more uniform across the fuser surface than the first post-fusing distribution.

Oil ghosting can show up as a gloss band which is caused by excess release agent (for example, oil) left on a fusing surface. This can happen in the inter document zone (the area between sheets of media) and/or outside the paper path. In the inter document zone (IDZ) there is no paper to transfer the release agent to, which results in the fusing surface being left with excess release agent. Also, long runs of narrow media can result in excess release agent collecting outside the paper path causing an undesirable gloss differential when switching to wider media. For ease of description, the term "oil" will be used to refer to release agents of all types.

Exemplary embodiments of the disclosure propose the use of a flexible blade (such as a T-blade) to remove part of the excess oil and smooth the oil layer so that oil ghosting will be mitigated to a point at which it is not detectable. This type of blade is similar to a blade that is used to remove water from cars, trucks, windows, mirrors, etc.

Applicants' tests show that when the blade is properly aligned and pressed against the fusing surface with an adequate force, oil ghosting can be eliminated.

Testing was performed using a T-blade made of silicone. However, other materials can be used as long as the material is flexible, can withstand the high temperatures that exist in an image fusing system, and are compatible with the release agent. In the particular case where the release agent is silicone oil and the fusing temperatures are above 180 degrees Celsius, a material such as Viton® will be suitable.

As used herein, the term "image forming device" encompasses any apparatus, such as a digital copier, bookmaking machine, multifunction machine, and the like, that performs a print outputting function for any purpose. The image forming device can be used to produce prints from various types of media, such as coated or uncoated (plain) paper sheets, at high speeds. The media can have various sizes and weights.

FIG. 1 shows an example of a partial image forming device in accordance with embodiments of the disclosure. In the example shown in FIG. 1, a fuser surface 110 is in the form of an endless belt that is guided by rolls 120, 130, 140, 150, and moves in a traveling direction T. Although fuser surface 110 is a belt in this example, the fuser surface can be a roll or other rotating member in other embodiments. Although embodiments of the disclosure will work with both fuser rolls and fuser belts (and other rotating members), it may be particularly beneficial when used with a fuser belt. Fuser rolls usually use a high pressure nip that can help in spreading the oil uniformly across the surface of the roll. Because fuser belts may not use a high pressure nip like that used by fuser rolls, embodiments of the disclosure may result in a bigger improvement in image quality in devices using a fuser belt than in devices using a fuser roll. In exemplary embodiments, a piece of media containing an image is passed between fuser surface 110 and a roll 160 to fuse the image to the piece of media.

As discussed above, a release agent is applied to fuser surface 110 during the operation of the image forming device. The release agent can be, for example, a silicone oil. The release agent builds up unevenly on fuser surface 110, especially in the IDZ and OPP, after images are fused to the media. To improve the image quality, an apparatus for redistributing release agent 200 is provided to redistribute the release agent more uniformly across the face of fuser surface 110. In the example shown in FIG. 1, two different possible locations (A, B) of apparatus 200 are shown. However, apparatus 200 could be located at locations other than A, B. The different approaches used at locations A, B will be discussed below.

Figure 2:
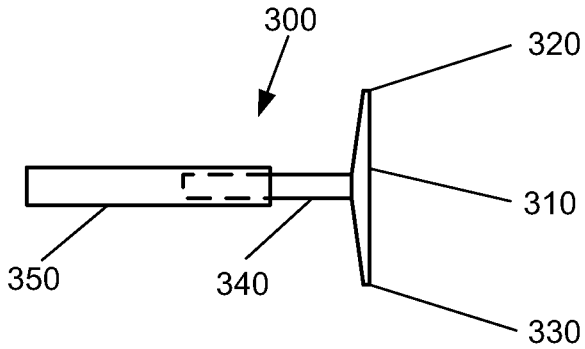
FIG. 2 schematically illustrates a particular example of various illustrative embodiments of a blade assembly in accordance with the present disclosure.

Apparatus 200 includes, in this example, a blade assembly 300, as shown in FIG. 2. Blade assembly 300 has a T-shaped blade 310 that is flexible so that it can conform to the shape of fuser surface 110. Blade 310 has two blade edges 320, 330 located at the extremities of blade 310. One of the blade edges 320, 330 is pressed into contact with fuser surface 110 such that the release agent on fuser surface 110 is spread substantially evenly across the width of fuser surface 110.

In embodiments, the fuser surface has an overall width in a transverse direction that is perpendicular to the travelling direction. Oil may be applied to a portion of the fuser surface that is less than the overall width of the fuser surface. As a result, blade 310 may have a length that is less than the overall width of the fuser surface or it may have a length that is equal, or greater than, the overall width of the fuser surface. For example, blade 310 may have a length substantially equal to the width of the oiled portion of the fuser surface. Embodiments may include a blade or blades that contact the fuser surface only at areas of the fuser surface that are not used to fuse images to media, such as, for example, areas at the edges of the fuser surface which are outside of the image area.

Exemplary embodiments of the disclosure position blade 310 such that it drags on fuser surface 110 while fuser surface 110 is supported on the hard surface of an internal roll (for example, roll 140 or 150). However, other embodiments can position blade 310 at a location where fuser surface 110 is not supported on the hard surface of an internal roll. The release agent removed by blade 310 can be collected in a pan 210 which can then be returned to the oil system. The oil return can, for example, go to the ram, to the oil bottle or to a separate oil waste bottle. Different orientations of the T-blade relative to fuser surface 110 can be used. For example, position A in FIG. 1 will permit the oil to flow directly off of blade edge 320, 330 into pan 210 and will help prevent paper fibers collecting on blade 310. Position B in FIG. 1 will collect oil on blade 310 and so blade 310 may have a slope in the cross-process direction in order to induce the oil to flow along blade 310 and into pan 210. However, paper fibers will have a higher tendency to collect on blade 310 in the orientation shown at position B. Depending on the orientation chosen for blade assembly 300, blade edge 320, 330 may be parallel to fuser surface 110 or slightly skewed. A skewed position of blade edge 320, 330 may be beneficial to provide the slope discussed above that can induce the oil to flow along blade 310.

As mentioned above, embodiments of the disclosure can be used in devices having fuser rolls as well as those (such as the embodiment shown) using a fuser belt. However, because a fuser belt typically has a greater perimeter than a fuser roll, a fuser belt provides more locations at which apparatus 200 can be beneficially located. A fuser belt provides more locations (than a fuser roll) at which apparatus 200 can be placed so that a blade such as blade 310 is positioned above a collection pan such as pan 210. Also, providing one or more rolls such as rolls 120, 140, 150 having a large diameter provides an increased area over which apparatus 200 can be placed and still be located above a pan such as pan 210.

FIG. 2 shows that blade 310 has a blade extension 340 that is held in a blade holder 350. Blade holder 350 is attached to a support frame or other structure of the image forming device. Blade holder 350 can be adjustable so that the position of blade 310 relative to the support frame can be adjusted. Blade holder 350 can hold blade extension 340 by way of a friction fit, screws, clamps, or other holding methods. In embodiments, blade holder 350 holds blade extension 340 in a movable manner such that a controller can direct blade holder 350 to extend or retract blade extension 340 between positions in which a blade edge 320, 330 is engaged with or disengaged with fuser surface 110. Other types of movement control devices can alternatively be used to move blade edge 320, 330 relative to fuser surface 110, such as, for example, a titling mechanism. The controller can control movement of the blade for many purposes. For example, the movement of the blade can be timed so that the blade engages the fuser surface at a position that corresponds to a position just before the trailing edge of a sheet of media. This would reduce the amount of, or eliminate, oil on the sheet of media where the media is to be bound to other sheets of media. This reduction, or elimination, of oil can help produce a stronger binding.

The viscosity of the oil usually decreases with increased temperature. This property can be used to produce better results depending on whether even spreading of the oil is desired or removal of the oil is desired. If even spreading of the oil is desired, the oil can spread by the blade at a point just after the oil has been heated (to reduce viscosity). The oil can be heated by heating the fuser surface through one of the rolls, for example, or some other heating device. If removal of the oil is desired, a higher viscosity is desirable. To obtain a higher viscosity, the oil can be scraped by the blade at a point on the fuser surface that is allowed to cool (or is not heated).

Figure 3:
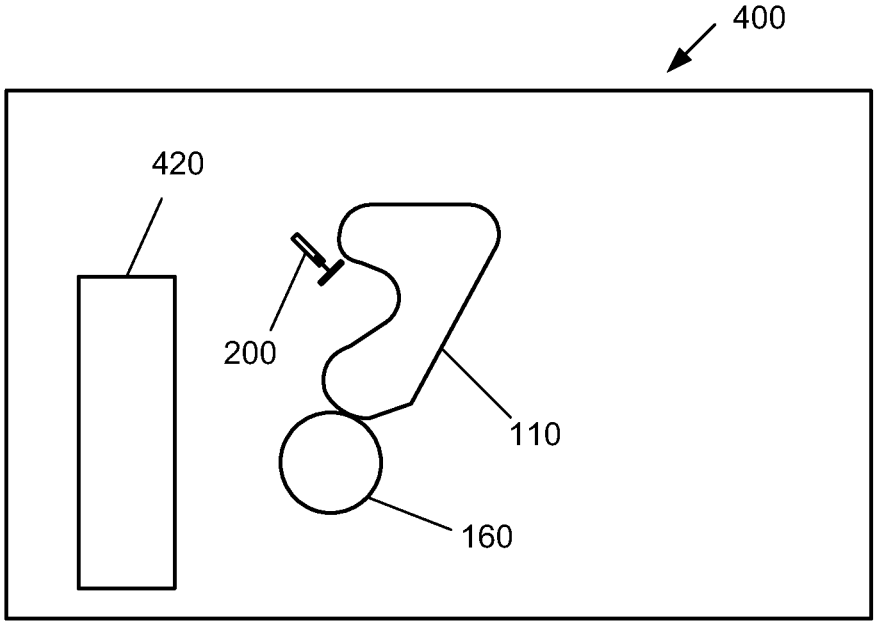
FIG. 3 schematically illustrates a particular example of various illustrative embodiments of an image forming system in accordance with the present disclosure.

FIG. 3 shows an example of an image forming device 400 in accordance with embodiments of the disclosure. Image forming device 400 includes a media storage device 420 for storing media that will have images formed thereon by image forming device 400. A paper path (not shown) moves paper or other media from media storage device 420 to various other sections in image forming device 400 including fuser surface 110. Fuser surface 110 is shown schematically along with roll 160 and apparatus for redistributing release agent 200. The functions of fuser surface 110, roll 160, and apparatus for redistributing release agent 200 are similar to those discussed above.

Figure 4:
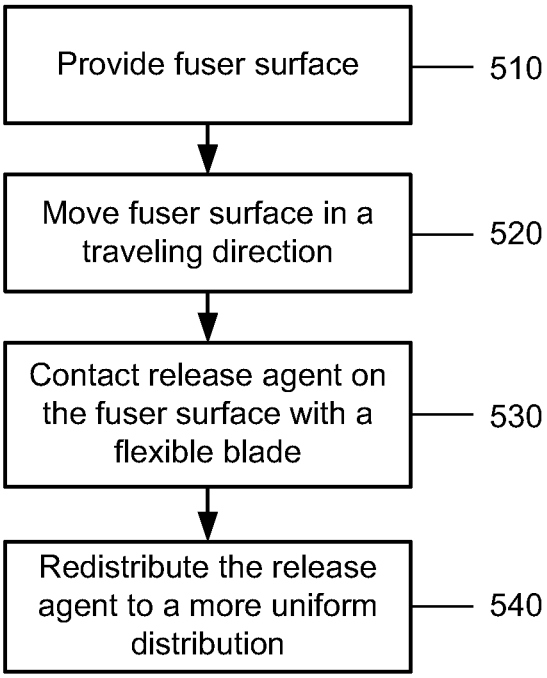
FIG. 4 shows a particular example of a method in accordance with the present disclosure.

FIG. 4 shows an example of a method in accordance with embodiments of the disclosure. A fuser surface, such as fuser surface 110, is provided in 510. The fuser surface is moved in a traveling direction, such as direction T, in 520. A flexible blade, such as blade 310, is brought into contact with a release agent that exists on the fuser surface in 530. In 540 the release agent on the fuser surface is redistributed by the flexible blade in order to form a more uniform layer of release agent on the fuser surface.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for redistributing release agent on a fuser surface of an image forming device, the apparatus comprising:

a fuser surface for contacting a sheet of media having an image formed thereon by the image forming device, the fuser surface moving in a traveling direction;

a flexible blade for redistributing the release agent on the fuser surface from a first post-fusing distribution to a second distribution, the flexible blade contacting the release agent on the fuser surface at a contact area and pressing the release agent against the fuser surface to redistribute the release agent from the first post-fusing distribution to the second distribution; and a catch tray positioned below the flexible blade to catch release agent removed from the fuser surface by the flexible blade, wherein the flexible blade is adapted to redistribute the release agent such that the second distribution is more uniform across the fuser surface than the first post-fusing distribution, the flexible blade is movable between an engaged position and a disengaged position during operation of the apparatus, and the contact area extends in a direction that is non-parallel to a transverse direction, the transverse direction being perpendicular to the traveling direction.

2. The apparatus of claim 1, wherein the fuser surface is a surface of a fuser belt.

3. The apparatus of claim 2, wherein the fuser surface has an overall width in the transverse direction, and an oiled width that is a portion of the overall width and to which release agent is applied, and the contact area extends substantially the entire oiled width of the fuser surface.

4. The apparatus of claim 3, wherein the contact area includes an inter document zone.

5. The apparatus of claim 3, wherein the contact area includes an outside paper path region.

6. The apparatus of claim 3, further comprising a support member supporting the fuser surface at the contact area.

7. The apparatus of claim 6, wherein the support member is a roll.

8. The apparatus of claim 2, wherein the fuser surface has an overall width in the transverse direction, and an oiled width that is a portion of the overall width and to which release agent is applied, and the contact area extends substantially the entire overall width of the fuser surface.

9. An image forming device, comprising:

a media transport path for transporting a sheet of media having an image formed thereon;

a fuser surface for contacting the sheet of media, the fuser surface moving in a traveling direction;

a flexible blade for redistributing release agent on the fuser surface from a first post-fusing distribution to a second distribution, the flexible blade contacting the release agent on the fuser surface at a contact area and pressing the release agent against the fuser surface to redistribute the release agent from the first post-fusing distribution to the second distribution; and a catch tray positioned below the flexible blade to catch release agent removed from the fuser surface by the flexible blade, wherein the flexible blade is adapted to redistribute the release agent such that the second distribution is more uniform across the fuser surface than the first post-fusing distribution, the flexible blade is movable between an engaged position and a disengaged position during operation of the apparatus, and the contact area extends in a direction that is non-parallel to a transverse direction, the transverse direction being perpendicular to the traveling direction.

10. The device of claim 9, wherein the fuser surface is a surface of a fuser belt.

11. The device of claim 10, wherein the fuser surface has an overall width in the transverse direction, and an oiled width that is a portion of the overall width and to which release agent is applied, and the contact area extends substantially the entire oiled width of the fuser surface.

12. The device of claim 11, wherein the contact area includes an inter document zone.

13. The device of claim 11, wherein the contact area includes an outside paper path region.

14. The device of claim 11, further comprising a support member supporting the fuser surface at the contact area.

15. The device of claim 14, wherein the support member is a roll.

16. The device of claim 10, wherein the fuser surface has an overall width in the transverse direction, and an oiled width that is a portion of the overall width and to which release agent is applied, and the contact area extends substantially the entire overall width of the fuser surface.

17. A method of redistributing release agent on a fuser surface of an image forming device, the method comprising:

providing a fuser surface for contacting a sheet of media having an image formed thereon by the image forming device;

moving the fuser surface in a traveling direction;

moving a flexible blade from a disengaged position that is not in contact with the fuser surface to an engaged position contacting a release agent present on the fuser surface with such that the flexible blade redistributes the release agent on the fuser surface from a first post-fusing distribution to a second distribution, the flexible blade contacting the release agent on the fuser surface at a contact area and pressing the release agent against the fuser surface to redistribute the release agent from the first post-fusing distribution to the second distribution; and collecting the release agent removed from the fuser surface by the flexible blade in a catch tray positioned below the flexible blade to catch the release agent, wherein the flexible blade redistributes the release agent such that the second distribution is more uniform across the fuser surface than the first post-fusing distribution, and the contact area extends in a direction that is non-parallel to a transverse direction, the transverse direction being perpendicular to the traveling direction.

18. The method of claim 17, wherein the fuser surface is provided on a surface of a fuser belt.

19. The method of claim 18, wherein the fuser surface has an overall width in the transverse direction, and an oiled width that is a portion of the overall width and to which release agent is applied, and the contact area extends substantially the entire oiled width of the fuser surface.

20. The method of claim 19, wherein the contact area is located at a position on the fuser surface that is warmer than other positions on the fuser surface, such that the second distribution is a uniform layer of release agent.

21. The method of claim 18, wherein the fuser surface has an overall width in the transverse direction, and an oiled width that is a portion of the overall width and to which release agent is applied, and the contact area extends substantially the entire overall width of the fuser surface.

* * * * *